United States Patent [19]

Waite

[11] 3,990,859

[45] Nov. 9, 1976

[54] EXHAUST SYSTEMS FOR INTERNAL COMBUSTION ENGINES

[75] Inventor: William Waite, Darlaston, England

[73] Assignee: Rubery, Owen & Co. Limited, Wednesbury, England

[22] Filed: Sept. 5, 1974

[21] Appl. No.: 503,354

[30] Foreign Application Priority Data

Sept. 5, 1973 United Kingdom ..... 41734/73

[52] U.S. Cl. ..... 23/288 FC; 29/455 R; 29/446; 29/463; 29/157 R

[51] Int. Cl.[2] ..... B01J 8/00

[58] Field of Search ..... 29/446, 455, 463, 157 R; 23/288 FC

[56] References Cited

UNITED STATES PATENTS

| | | | |
|---|---|---|---|
| 3,002,870 | 10/1961 | Belgrade et al. | 29/463 UX |
| 3,801,289 | 4/1974 | Wiley | 23/288 FC |
| 3,817,714 | 6/1974 | Wiley | 23/288 FC |
| 3,841,839 | 10/1974 | Wiley | 23/288 FC |

*Primary Examiner*—Charlie T. Moon
*Attorney, Agent, or Firm*—Schrivener Parker Scrivener and Clarke

[57] ABSTRACT

In an exhaust system for an internal combustion engine incorporating a housing enclosing a ceramic block coated with catalytic material for removing noxious matters from the exhaust gases, the housing is formed from two or more drawn or pressed stainless steel members which are assembled around the block and welded together while axially directed pressure is applied to the members to compress the block axially with a pressure which is maintained on the block in the completed unit.

4 Claims, 8 Drawing Figures

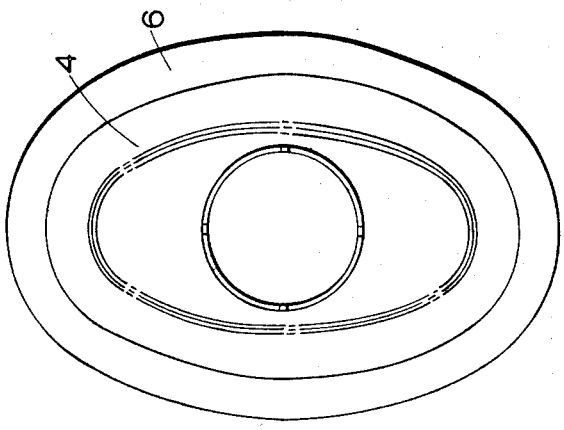
FIG. 3.
FIG. 4.
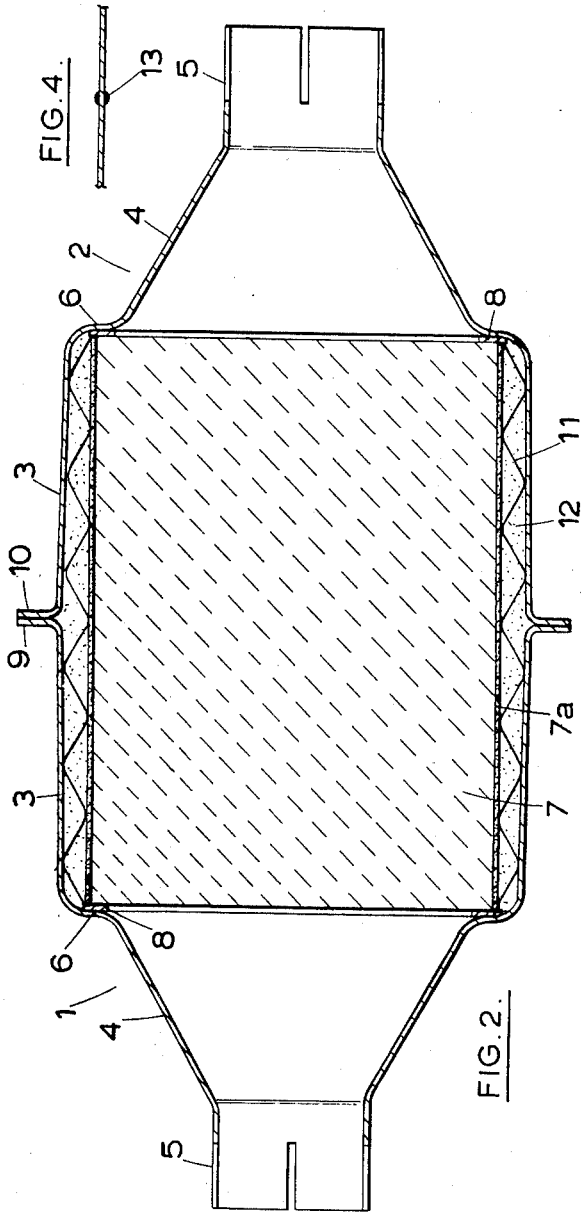
FIG. 2.
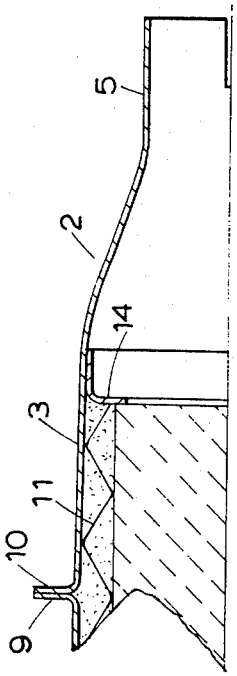
FIG. 5.

EXHAUST SYSTEMS FOR INTERNAL COMBUSTION ENGINES

This invention relates to improvements in exhaust systems for internal combustion engines and more particularly internal combustion engines for the propulsion of road vehicles.

With the great increase of motor vehicles on the road there is a growing awareness of the danger to health from exhaust gases which are normally discharged directly into the atmosphere. In some countries legislation has been passed limiting the proportion of certain gases and other noxious matters permissible in the exhaust gases discharged from the engine of a road vehicle, and vehicle manufacturers are exploring methods of complying with the requirements.

One known method is to cause the exhaust gases to pass through a porous monolithic block of ceramic material coated with finely divided platinium or other catalytic material. The ceramic material is usually located in a housing adapted to be connected into the exhaust system of an engine and it is desirable that the ceramic material should be effectively protected from damage by shock or vibrations when the vehicle is in motion.

Experience has shown that it is also desirable to keep the ceramic block under axial load to prevent it from breaking up under vibration.

It is an object of the present invention to provide in combination a housing which connects into the exhaust system of an internal combustion engine and is of two part construction, and a monolythic ceramic block which carries a catalyst and is located in the housing under axially compressive pressure by abutments in the housing which bear on parallel opposed flat ends of the block and prevent exhaust gases from flowing through the housing around the outside of the block.

The housing may be a cylinder of circular, elliptical or other convenient cross-section and provides room for resilient packing around the ceramic block.

Two embodiments of our invention are illustrated by way of example in the accompanying drawings in which:

FIG. 2 is a longitudinal section on the line 2—2 of FIG. 1,

FIG. 3 is an end view,

FIG. 4 is a fragmentary section showing an alternative method of connecting the parts of the housing, FIG. 5 is a fragmentary section showing an alternative form of end abutment for the ceramic block.

Figure 1:
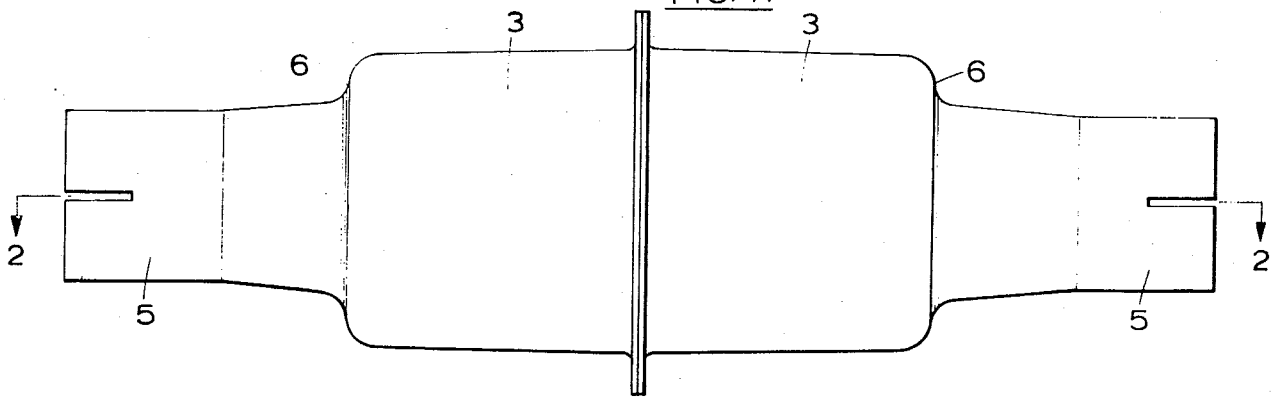
FIG. 1 is a plan view of a complete unit.

In the construction shown in FIGS. 1 to 3 a housing for a ceramic block is formed from two cooperating drawn stainless steel shells 1, 2 each of generally funnel shape with a first portion 3 of uniform elliptical cross-section and a tapered end portion 4 merging into a cylindrical hollow spigot portion 5 for connection into the exhaust system of an engine.

Each shell is formed with a radial shoulder 6 at the junction of the first portion 3 with the tapered portion 4 and this shoulder may provide an abutment for the end of a monolithic ceramic block 7, or a stainless steel ring 8 of flat or angle section may be welded into the shell against the shoulder for that purpose.

For securing the two shells together their open ends are formed with radial flanges 9, 10 which are adapted to abut and to be spot-welded or resistance welded together.

The internal diameter of the housing is greater than that of the ceramic block to accommodate resilient packing enclosing the block. This packing is formed by crimped stainless steel mesh 11 which may be used alone but is preferably embedded in ceramic or other heat-insulating fibres 12 which can be vacuum-formed on to the mesh.

The peripheral surface of the ceramic block is not necessarily smooth and is liable to contain small interstices or pits, and the block is coated with a surface layer 7*a* of fire-resistant cement. This has a smooth external surface which makes a gas-tight seal with the packing when the unit is assembled and prevents the leakage of untreated exhaust gases past the ceramic block.

A slight taper may be provided in the portions 3 of the shells in such a direction that as the shells are advanced towards each other in the assembling operation the crimps in the mesh 11 are slightly flattened and closed in to apply radially directed pressure to the ceramic block.

In assembling the unit the ceramic block with the packing around it is inserted into one shell. The other shell is then fitted over the block and axial pressure is applied hydraulically or by any other convenient means until the flanges 9, 10 abut, and the flanges are then welded together. The dimensions of the two shells in relation to the axial length of the ceramic block are such that axial compression of the block is required to bring the flanges into abutting engagement and as the shells are substantially inelastic the pressure is maintained on the block in the finished unit.

Tests have shown that the axial pressure on the ceramic block should be of the order of 1000 pounds per square inch to ensure continued stability of the block.

Instead of providing radial flanges on the shells their open ends may simply abut and be butt-welded together as shown at 13 in FIG. 4.

In the modification shown in FIG. 5, instead of the shells being formed with the internal shoulders 6 the portion 3 of each shell merges directly with a taper into the spigot portion 5, and end abutments for the ceramic block are formed by rings 14 of angle section welded into the shells.

Figure 6:
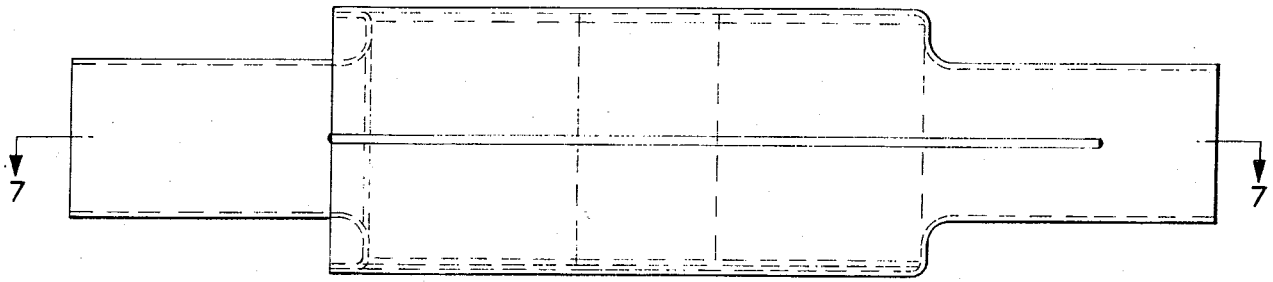
FIG. 6 is a plan of a modified form of housing.
Figure 8:
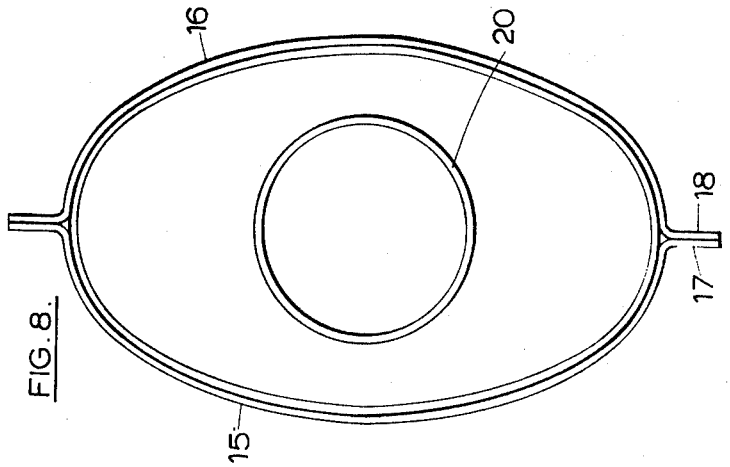
FIG. 8 is an end view.
Figure 7:
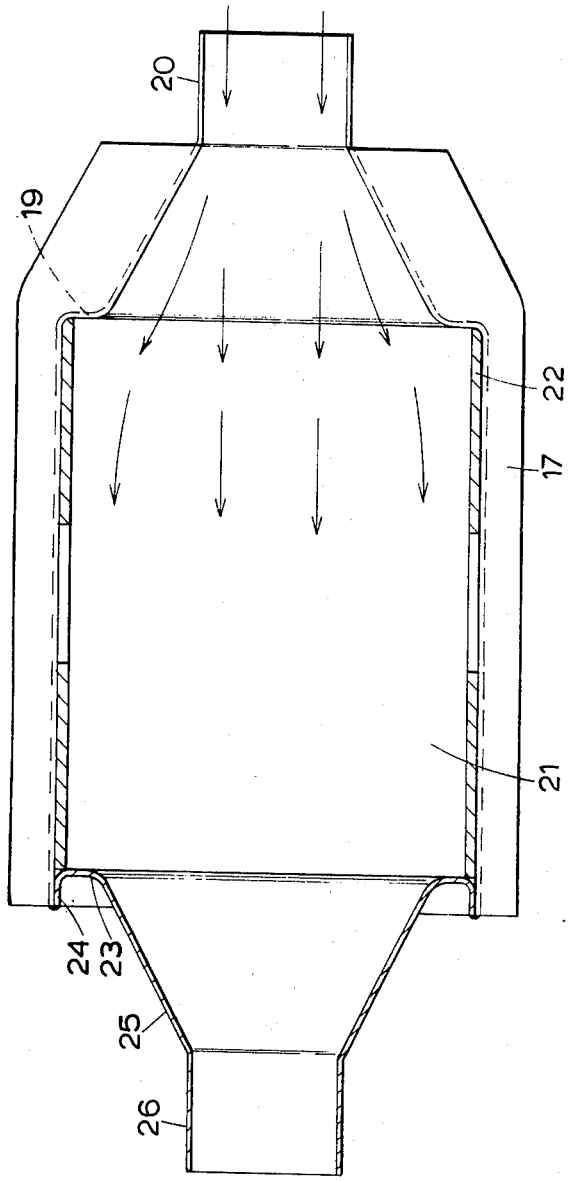
FIG. 7 is a longitudinal section on the line 7—7 of FIG. 6.

In the alternative construction shown in FIGS. 6, 7 and 8 a hollow housing or circular or elliptical cross-section is formed from two pressings 15 and 16 having on their free edges meeting flanges 17, 18 which are welded together.

At one end the housing tapers off from an annular internal shoulder 19 into a spigot portion 20 for connection into an exhaust system.

The other end is open. In assembling the unit the ceramic block 21, surrounded by a layer of packing 22, is inserted into the open end of the housing which is then closed by an end member. This member is a pressing incorporating a flange 23 having a reversed axially directed annular lip 24 which is a close or press fit into the open end of the housing. The flange leads by way of a frusto-conical part 25 into a spigot portion 26.

When the end member is inserted into the housing it is subjected to axial pressure while the lip 24 is welded to the housing, the pressure being such as to compress the ceramic block to a predetermined extent between the flange 23 and the shoulder 19 in the housing. The block is thus held under compression in the finished unit.

The part of the housing which receives the ceramic block may be formed with a slight taper in such a direction that as the block is inserted into the housing the packing around the inner end of the block is compressed to apply radially directed pressure to the block.

While the ceramic block has been referred to herein as monolithic it will be appreciated that it may comprise two or more blocks located in tandem within the housing.

I claim:

1. In combination a rigid housing, means for connecting said housing into the exhaust system of an internal combustion engine, and located in said housing a monolythic ceramic block which carries a catalyst and has parallel opposed flat ends normal to a central axis of said block and passages extending between said flat ends for the flow of exhaust gases, said housing consisting of two drawn or pressed, oppositely extending, generally tubular, metallic members which together enclose said block, have adjacent ends which are welded together, and incorporate annular, imperforate, internal abutments extending around the inside of the housing which project inwards towards said central axis parallel to said flat ends adjacent the edges thereof and which compressively bear on said flat ends and seal said members to said block at said flat ends, such that exhaust gases cannot flow through said housing around the outside of said block, and one of said members having an inlet for exhaust gases opposite one of said flat ends of said block, and the other one of said members having an outlet for exhaust gases opposite the other end of said flat ends.

2. In combination a rigid housing, means for connecting said housing into the exhaust system of an internal combustion engine, and located in said housing a monolythic ceramic block which carries a catalyst, has parallel opposed flat ends normal to a central axis of said block, passages extending between said flat ends for the flow of exhaust gases, and has a peripheral surface extending between said flat ends coated with a layer of heat-resistant cement which presents a smooth and uninterrupted external surface, said housing consisting of two drawn or pressed, oppositely extending, generally tubular, metallic members which together encompass said block whilst leaving a space around said peripheral surface, have adjacent ends which are welded together, and incorporate annular, imperforate, internal abutments extending around the inside of the housing which project inwards towards said central axis parallel to said flat ends adjacent the edges thereof and which compressively bear on said flat ends, seal said members to said block at said flat ends and close off opposite ends of said space adjacent said flat ends, thereby to prevent exhaust gases from entering into said space, and one of said members having an inlet for exhaust gases opposite one of said flat ends, and the other one of said members having an outlet for exhaust gases opposite the other one of said flat ends, and resilient heat insulating packing which is located under compression in said space around said block between said block, said members and said abutments, and inhibits flow of exhaust gases in said space.

3. The combination as claimed in claim 2 in which each said member has a cylindrical portion which surrounds said peripheral surface of said block, a tapered portion extending beyond said block, said tapered portion of one of said members containing said inlet and said tapered portion of the other one of said members containing said outlet, and each said member having a shoulder which joins said cylindrical portion of said tapered portion and constitutes one of said abutments.

4. The combination as claimed in claim 2 in which each said member has a cylindrical portion which surrounds said peripheral surface of said block and a tapered portion joined to said cylindrical portion and extending beyond said block, said tapered portion of one of said members containing said inlet and said tapered portion of the other one of said members containing said outlet, and each said member having therein a ring which is welded to said member adjacent the junction between said cylindrical and tapered portion and constitutes one of said abutments.

* * * * *